United States Patent [19]

Thoma et al.

[11] Patent Number: 4,881,981

[45] Date of Patent: Nov. 21, 1989

[54] METHOD FOR PRODUCING A SHAPE MEMORY ALLOY MEMBER HAVING SPECIFIC PHYSICAL AND MECHANICAL PROPERTIES

[75] Inventors: Paul E. Thoma, Wauwatosa; David N. AbuJodom, II, Brookfield; Sepehr Fariabi, Shorewood, all of Wis.

[73] Assignee: Johnson Service Company, Milwaukee, Wis.

[21] Appl. No.: 183,818

[22] Filed: Apr. 20, 1988

[51] Int. Cl.[4] ..... C22F 1/10

[52] U.S. Cl. ..... 148/11.5 R; 148/11.5 N; 148/402

[58] Field of Search ..... 148/11.5 R, 11.5 N, 148/2, 402, 13

[56] References Cited

U.S. PATENT DOCUMENTS 3,174,851 3/1965 Buchler et al. ..... 75/170

4,310,354 1/1982 Fountain et al. ..... 75/211

OTHER PUBLICATIONS

Effect of Heat Treatment after Cold Working on the Phase Transformation in TiNi Alloy, Todoroki, et al., Transactions of the Japan Institute of Metals, vol. 28, No. 2, (1987), pp. 83–94.

Effects of Stresses on the Phase Transformation of Nitinol, D. Goldstein, et al., Naval Surface Weapons Center, 04/02/86.

*Primary Examiner*—R. Dean

*Attorney, Agent, or Firm*—Foley & Lardner

[57] ABSTRACT

A process for adjusting the physical and mechanical properties of a shape memory alloy member of a known chemical composition comprising the steps of increasing the internal stress level and forming said member to a desired configuration and heat treating said member at a selected memory imparting temperature.

25 Claims, 15 Drawing Sheets

METHOD FOR PRODUCING A SHAPE MEMORY ALLOY MEMBER HAVING SPECIFIC PHYSICAL AND MECHANICAL PROPERTIES

BACKGROUND OF THE INVENTION

1. Field of the Invention

The present invention relates to a method for producing a shape memory alloy (SMA) member having a range of specific physical and mechanical properties and more particularly to the control of the physical and mechanical properties by the introduction of predetermined internal stresses into the alloy prior to a predetermined memory imparting heat treatment.

2. Description of the Prior Art

A nickel-titanium alloy, such as Nitinol (NiTi) is known to have the ability to recover its original shape when deformed in its Martensite and/or Rhombohedral phase(s), and then heated to the Austenite phase. This characteristic of shape memory alloy is generally attributed to the basic chemical composition of the alloy, processing, and the memory imparting heat treatment.

There are a number of articles which describe the aforementioned characteristic of SMA. These include U.S. Pat. Nos. 4,310,354 and 3,174,851 as well as an article from the Naval Surface Weapons Center entitled "Effects of Stresses On The Phase Transformation of Nitinol" (NSWC TR 86-196 1986) and "Effect of Heat Treatment After Cold Working on the Phase Transformation of TiNi Alloy" Transactions of the Japan Institute of Metals, Vol. 28, No. 2 (1987) pages 83–94.

All of these articles are concerned with the generally known processes for making a SMA alloy. This includes the steps of initially selecting an alloy of a predetermined composition, forming the alloy to a desired shape, and subjecting the alloy to a predetermined memory imparting heat treatment. Even though close control of the alloy's chemical composition and memory imparting heat treatment is maintained, a considerable variation in transformation temperatures has been known to occur. This has generally been attributed to process variables and other unknown factors. This limits the use of SMA alloys in applications where more precise transformation temperatures, and other mechanical and physical properties are sought.

SUMMARY OF THE INVENTION

In the present invention, a process has been developed that controls and adjusts the physical and mechanical properties of SMA. The physical properties include, but are not limited to, transformation temperatures of the various SMA phases, the resulting hysteresis between such phases, suppression of the Martensite phase in relation to the Rhombohedral phase, and the relationship between the start and finish temperatures of the respective phases. Mechanical properties that are controlled and adjusted by this invention include, but are not limited to, the yield point, ultimate tensile strength, and ductility. This has been accomplished by the introduction of a known internal stress and the distribution of that stress in the SMA prior to final fabrication of the SMA to a desired shape and prior to imparting memory through a predetermined heat treatment schedule.

The primary object of this invention is to control and adjust the transformation temperatures of SMA by the introduction and distribution of known internal stresses into a SMA member of a known composition prior to a memory imparting heat treatment.

Another object of the invention is to control other physical properties and the mechanical properties of SMA by the introduction and distribution of known internal stresses in a SMA member of a known composition prior to a memory imparting heat treatment.

A primary feature of the invention is the ability to provide precise transformation temperatures and other physical and the mechanical properties in an SMA alloy of known composition.

Other principal features and advantages of the invention will become apparent to those skilled in the art upon review of the following detailed description, claims and drawings.

DETAILED DESCRIPTION OF THE DRAWINGS

FIG. 1 is a typical DSC curve showing an A to R to M to A (ARMA) transformation reaction for a low amount, under 15% cold reduction in area, of internal stress introduced prior to heat treatment where A, R and M denote Austenite, Rhombohedral and Martensite phases, respectively.

FIG. 1*a* is a typical DSC curve showing an A to R to A (ARA) transformation reaction for the same sample as in FIG. 1.

FIG. 2 is a typical DSC curve showing the ARMA transformation reaction for a moderate amount, 35% cold reduction in area, of internal stress introduced prior to heat treatment.

FIG. 2*a* is a typical DSC curve showing an ARA transformation reaction for the same sample as in FIG. 2.

FIG. 3 is a typical DSC curve showing an ARMA transformation reaction for a high amount, 55% cold reduction in area, of internal stress introduced prior to heat treatment.

FIG. 3*a* is a typical DSC curve showing an ARA transformation reaction for the same sample as in FIG. 3.

Figure 1:
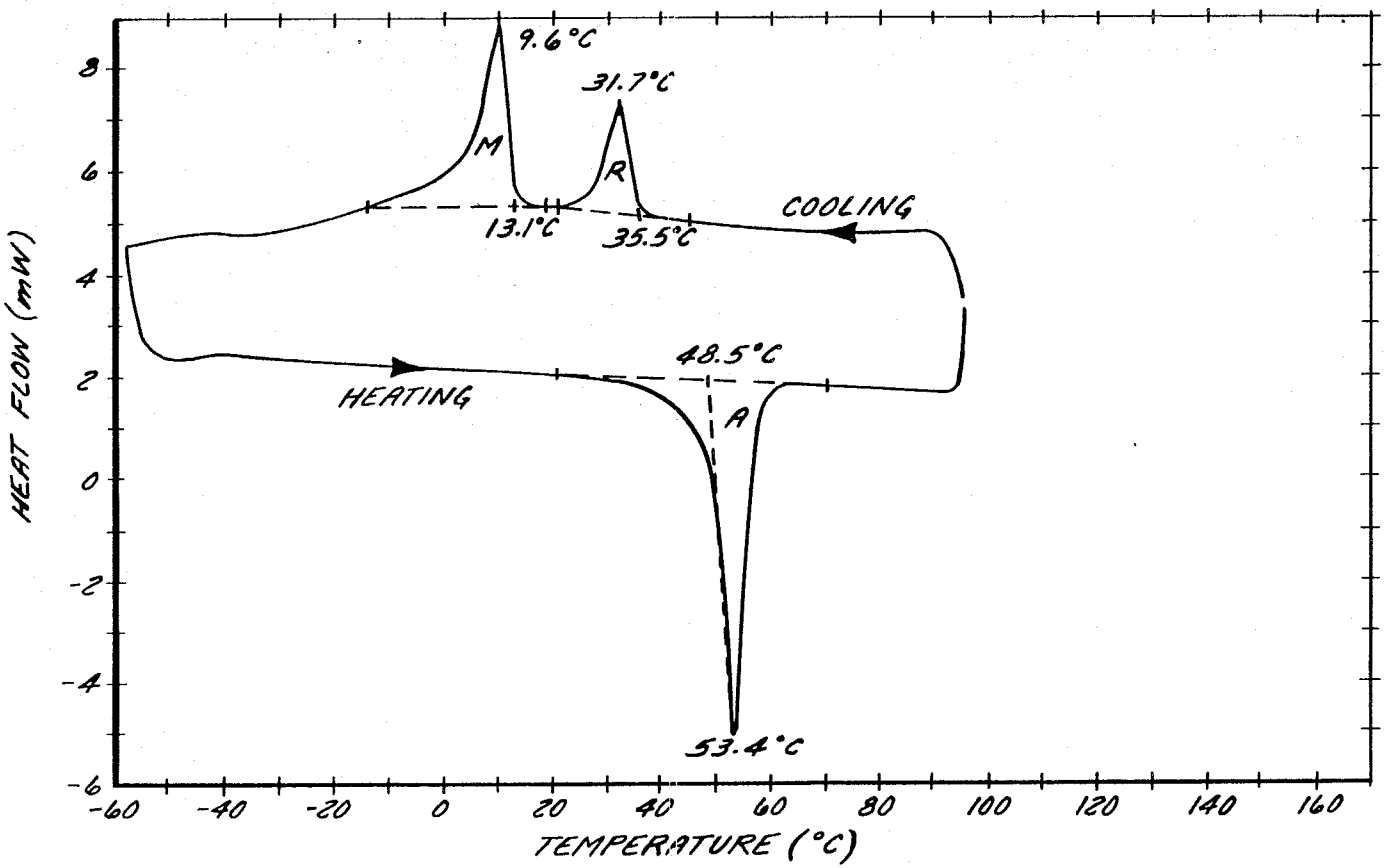

Before the invention is explained in detail, it is to be understood that the invention is not limited in its application to the details as set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE INVENTION

The Shape Memory Alloy (SMA) described herein is a near equiatomic alloy of nickel and titanium. This alloy is used for illustration purposes only, as other SMA alloys will also respond in a similar fashion.

The process according to the present invention generally includes the selection of an SMA of a known composition. Annealing of the alloy to a reference stress level for a predetermined time. Cold forming of the alloy to introduce a controlled amount of internal stress into the alloy.

The next step includes the forming of the alloy to a desired shape or configuration. Fixuring the alloy to the desired shape memory configuration. Heat treating of the alloy at a selected memory imparting temperature for a fixed period of time and allowing the alloy to cool to ambient temperature. The SMA is then removed from the fixture. Determining the transformation temperature of the SMA for the Austenite, Rhombohedral and Martensite phases. A family of curves for these phases can be established by repeating the above process at different internal stresses and different memory imparting temperatures as described now fully hereinafter.

In the following example a wire of about 1 to 2 mm. in diameter drawn from the SMA was annealed at temperatures between 300° and 950° C. for a specific length of time, generally between five minutes and two hours. The annealing process reduces the amount of internal stress to a reference level in preparation for subsequent introduction or addition of internal stress.

The annealed wire is then processed to introduce or add various amounts of internal stresses by cold reducing the wire by a specific amount. Calculations are based upon the initial and final diameters of the cold worked wire. This step in the process is particularly significant since internal stresses make it posible to adjust and control the transition temperatures and other physical and mechanical properties of the alloy. The alloy is then formed to a desired configuration and supported in the desired shape memory configuration. The alloy is then heated at at a selected memory imparting temperature and cooled. The following Figures show the transformation phases at various internal stress levels.

Figure 1A:
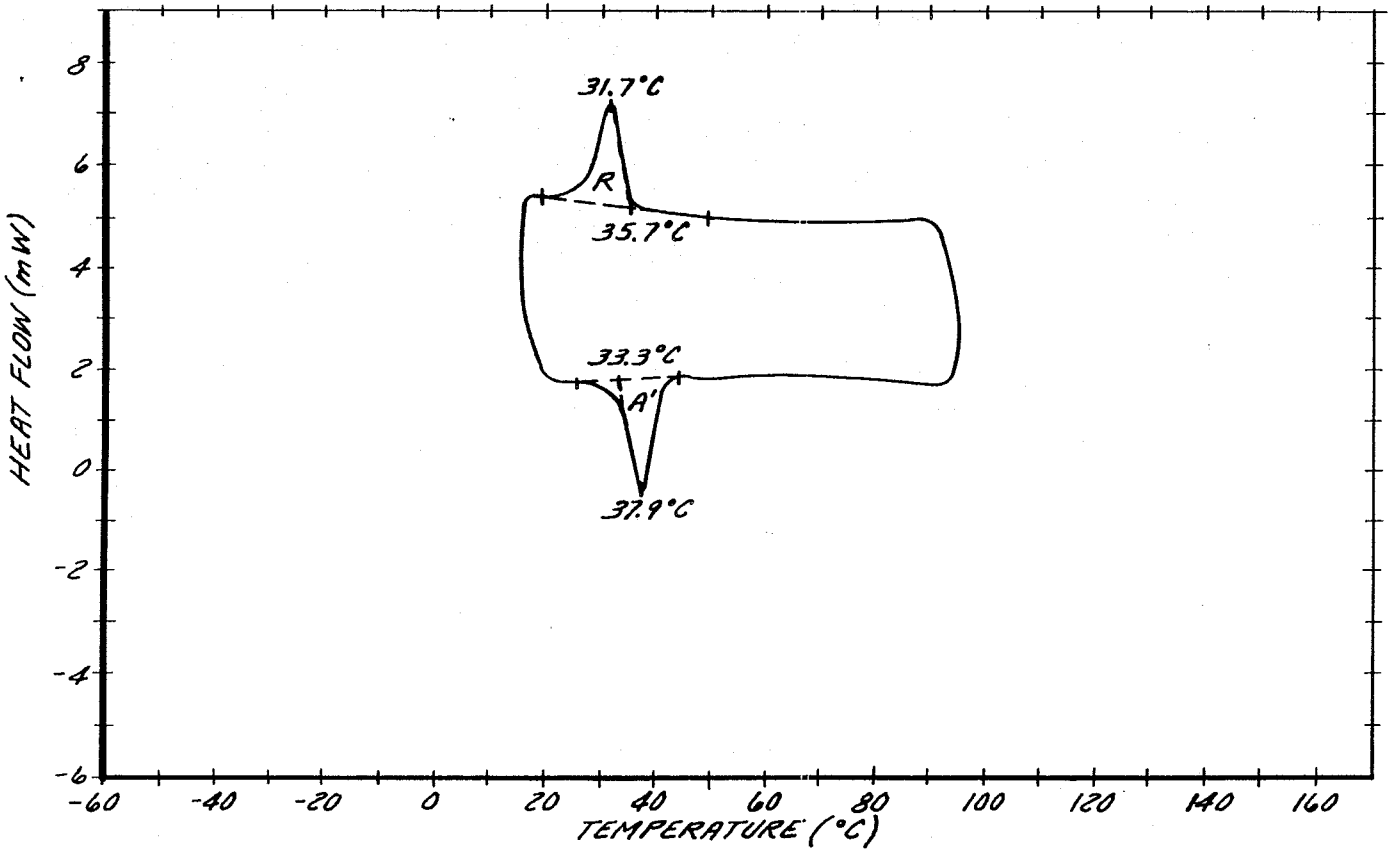

Referring to FIGS. 1 and 1*a*, the transformation reactions: Austenite to Rhombohedral to Martensite to Austenite phase changes (ARMA) and the Austenite to Rhombohedral to Austenite phase changes (ARA) are depicted using Differential Scanning Calorimetry (DSC) plots. The plots show transition temperatures for low amounts of cold reduction (close to 15%) for this alloy at peak temperatures of 53.4°, 37.9°, 31.7° and 9.6° C. for the A, A', R and M phases respectively for 1 hour at 475° C. memory imparting temperature.

Figure 2:
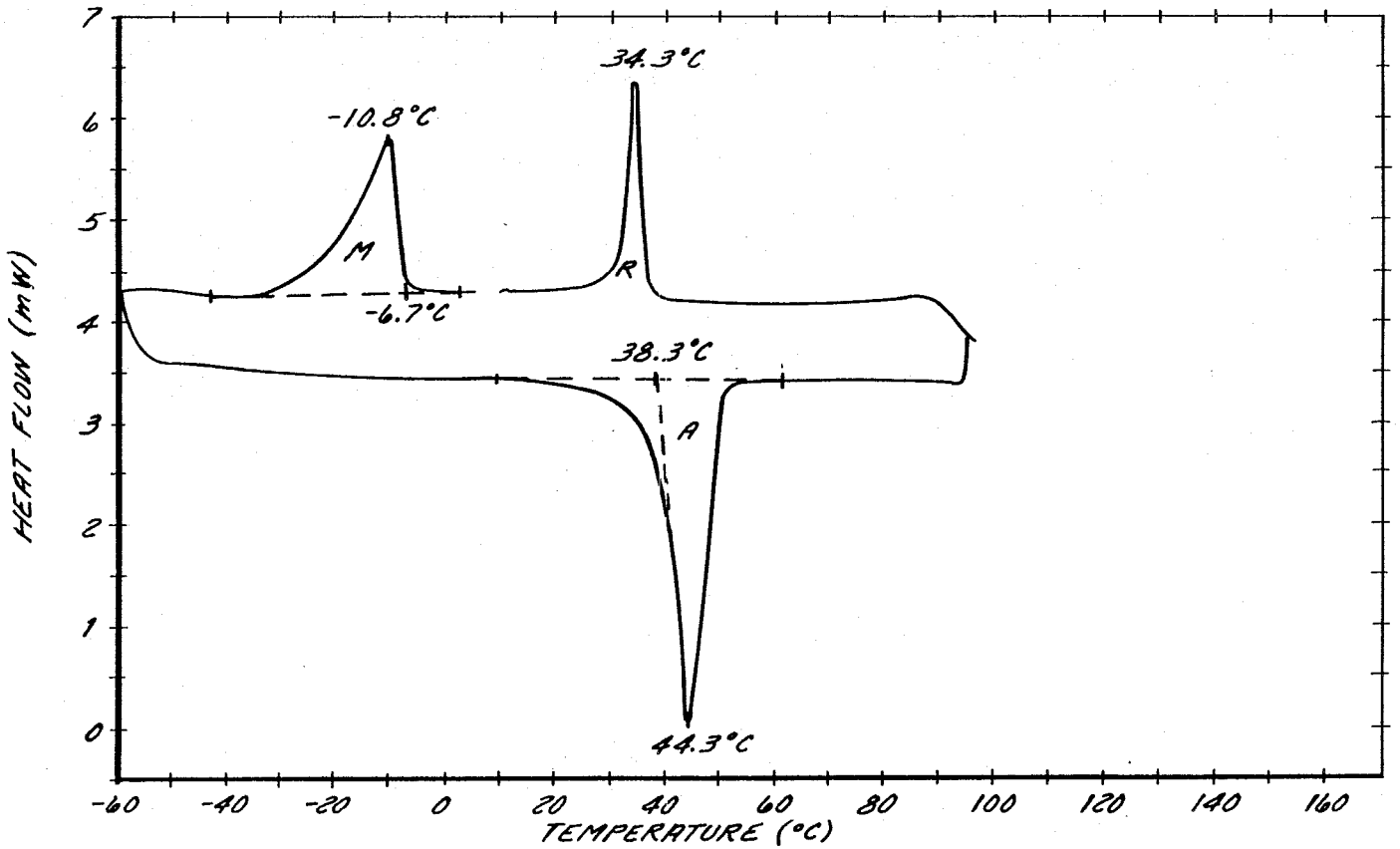
Figure 2A:
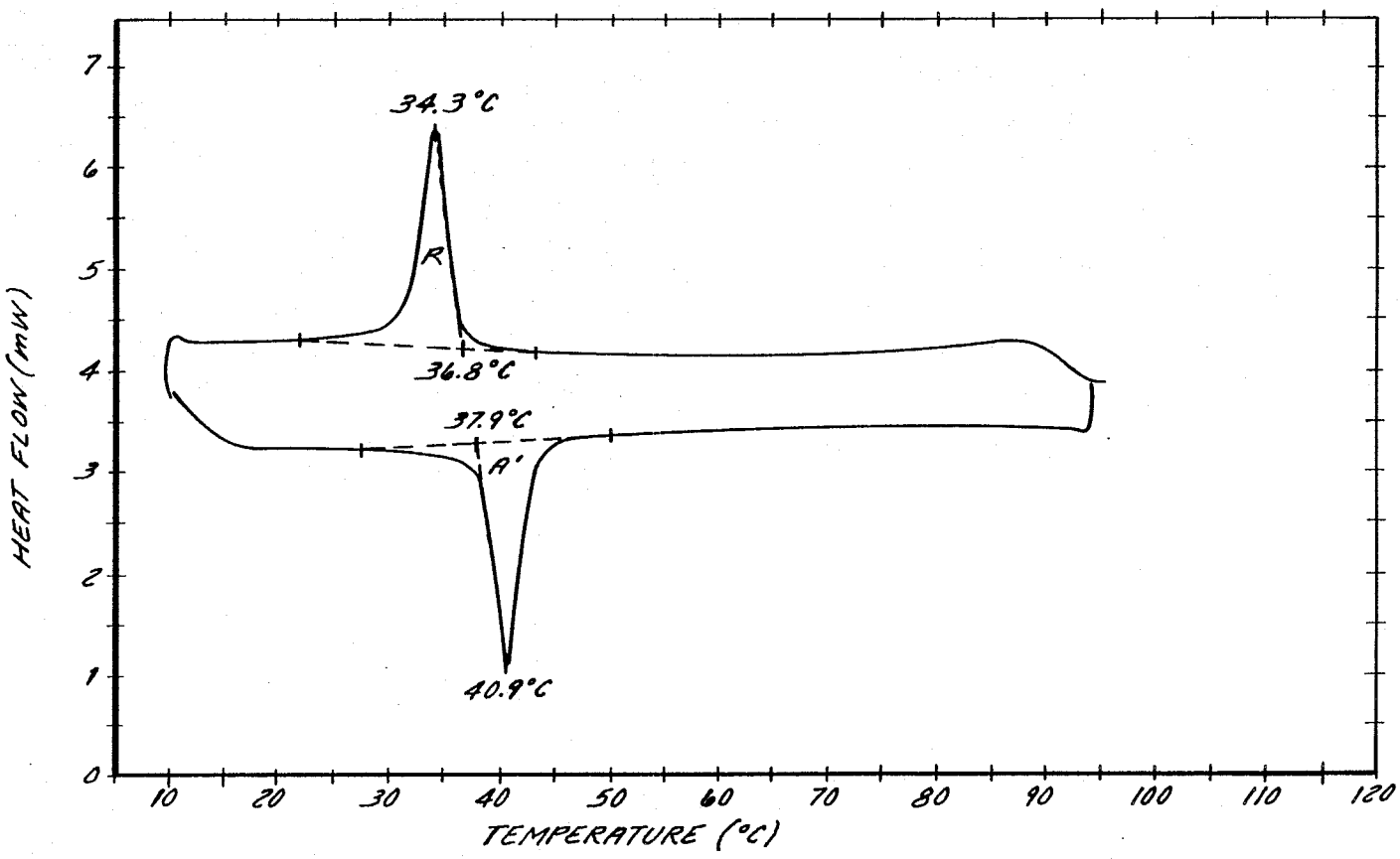

Referring to FIGS. 2 and 2*a*, the transformation reaction: Austenite to Rhombohedral to Martensite to Austenite phase changes (ARMA) and the Austenite to Rhombohedral to Austenite phase changes (ARA) are depicted using Differential Scanning Calorimetry (DSC) plots. The plots show transition temperatures for moderate amounts of cold reduction (close to 35%) for this alloy with peak temperatures of 44.3°, 40.9°, 34.3° and −10.8° C. for the A, A', R and M phases respectively for 1 hour at 475° C. memory imparting temperature.

Figure 3:
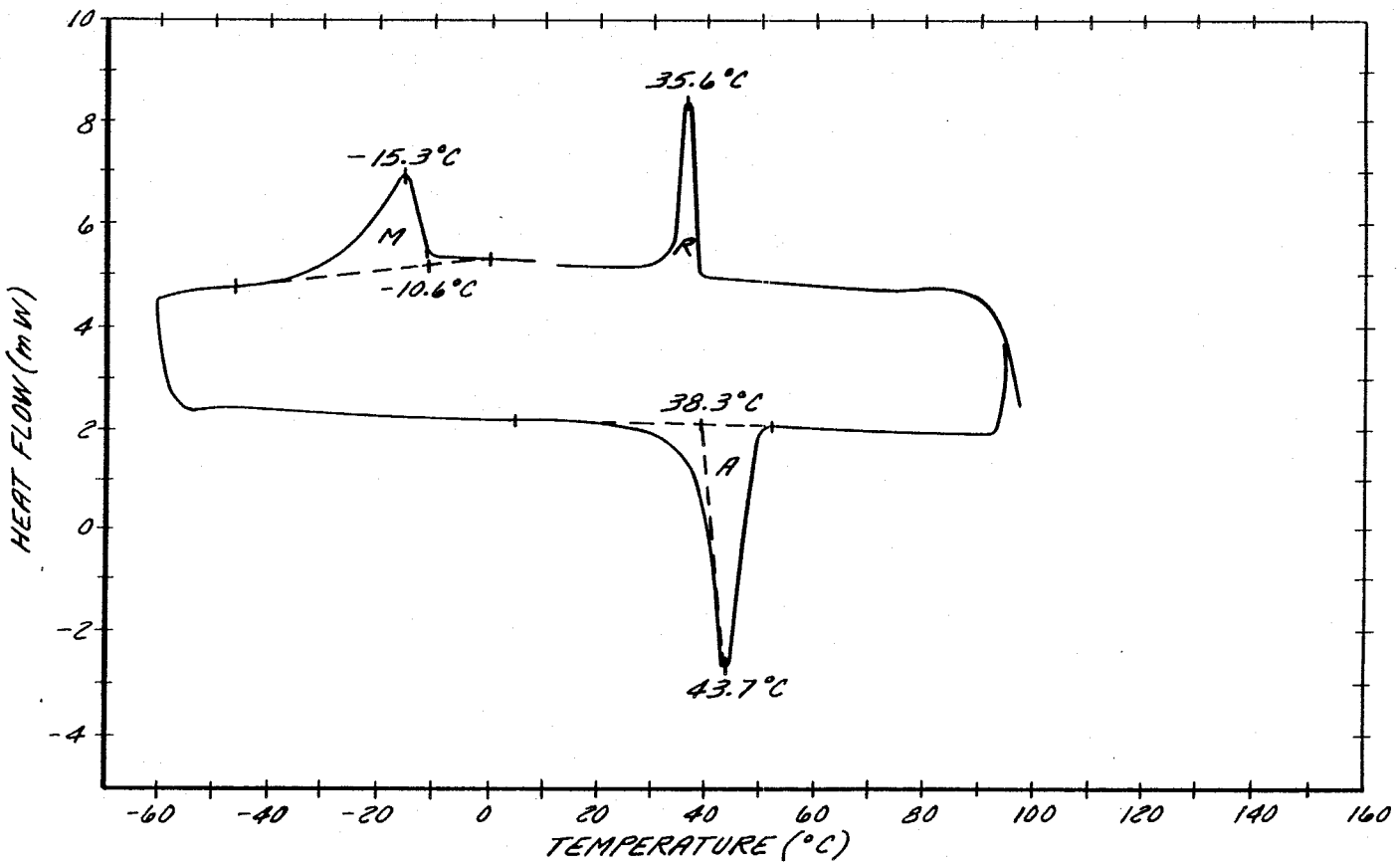
Figure 3A:
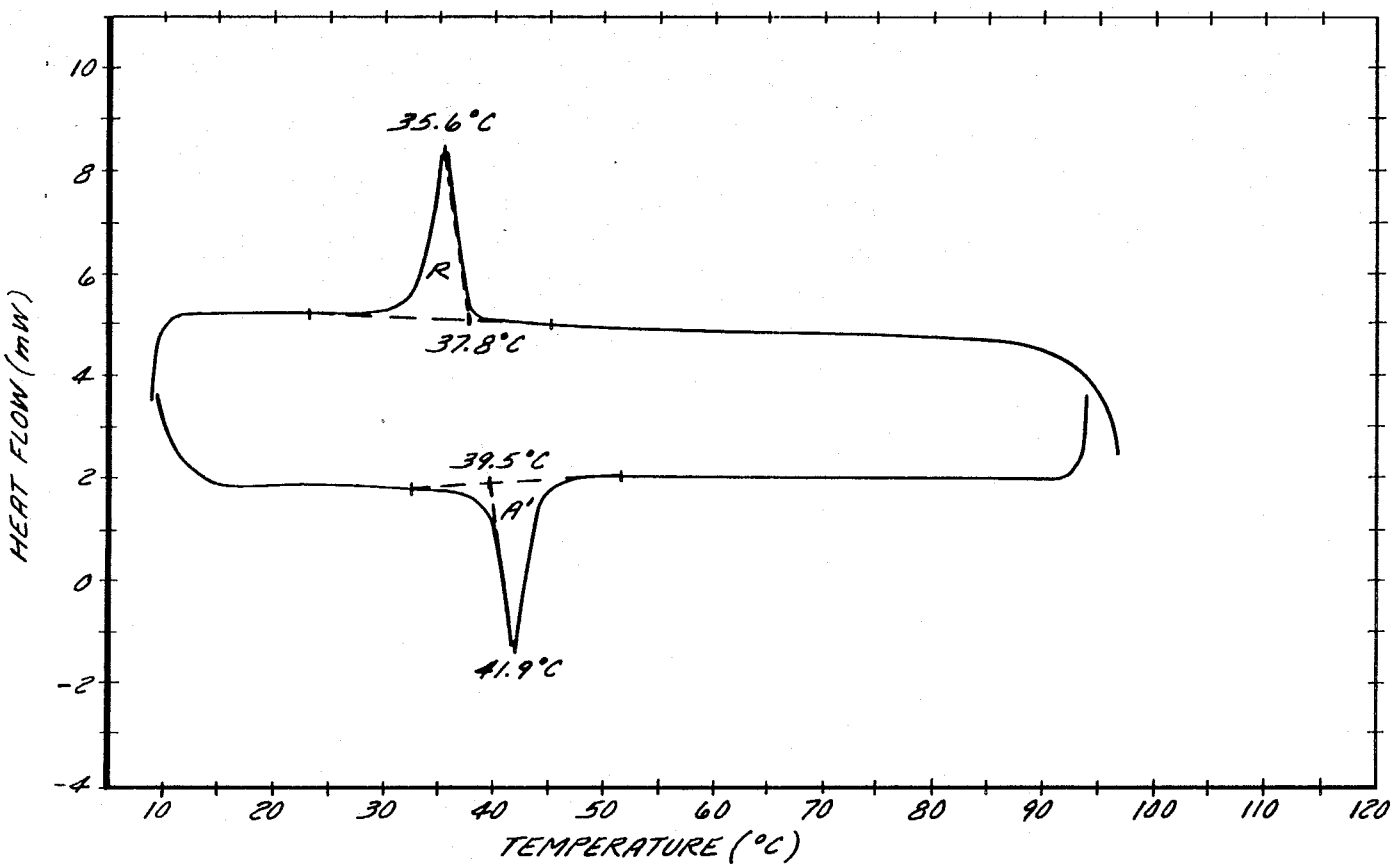
Figure 4:
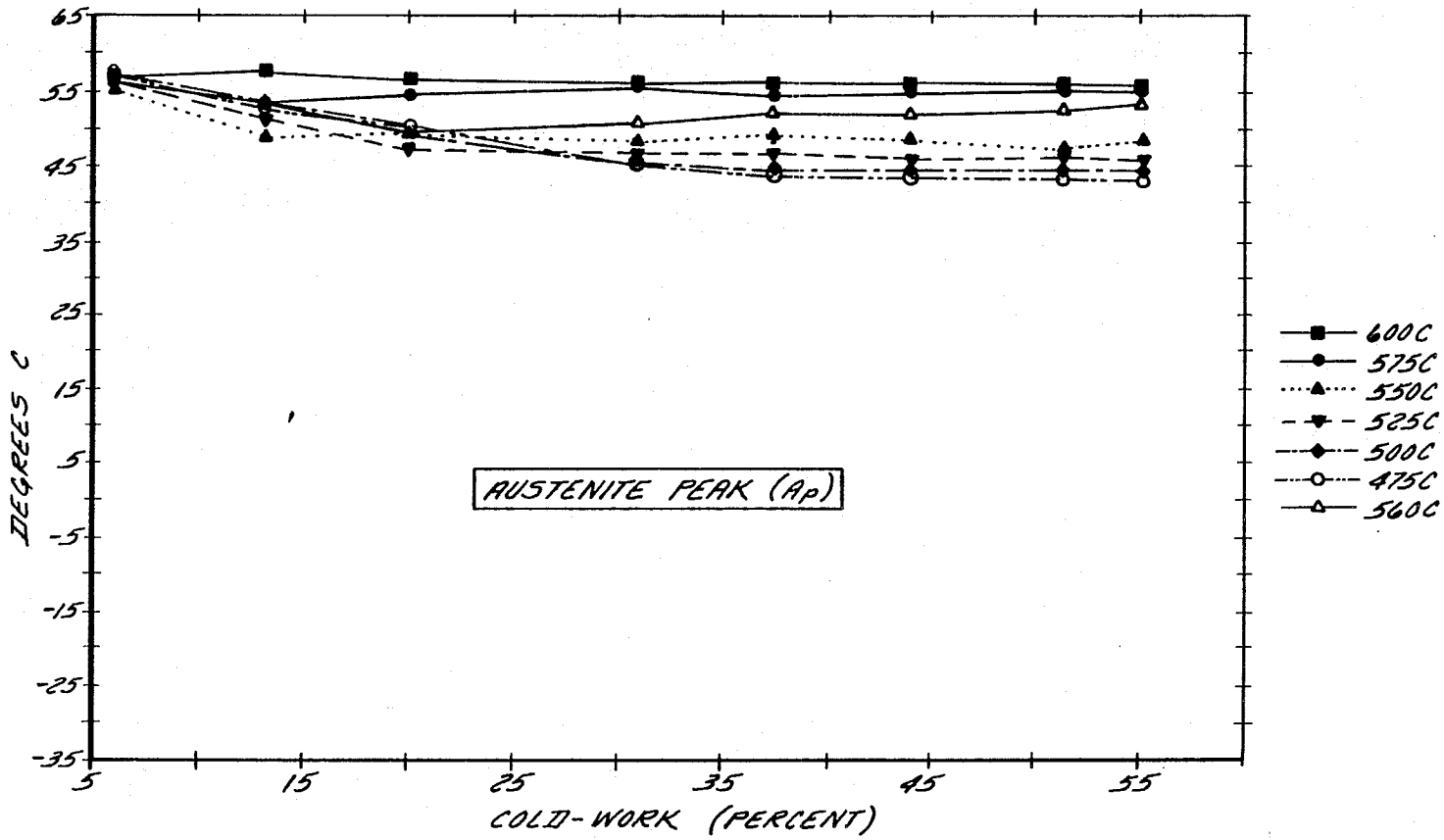
FIG. 4 is a family of curves showing the Austenite peak temperature of the ARMA reactions at different amounts of internal stress and memory imparting temperatures.
Figure 5:
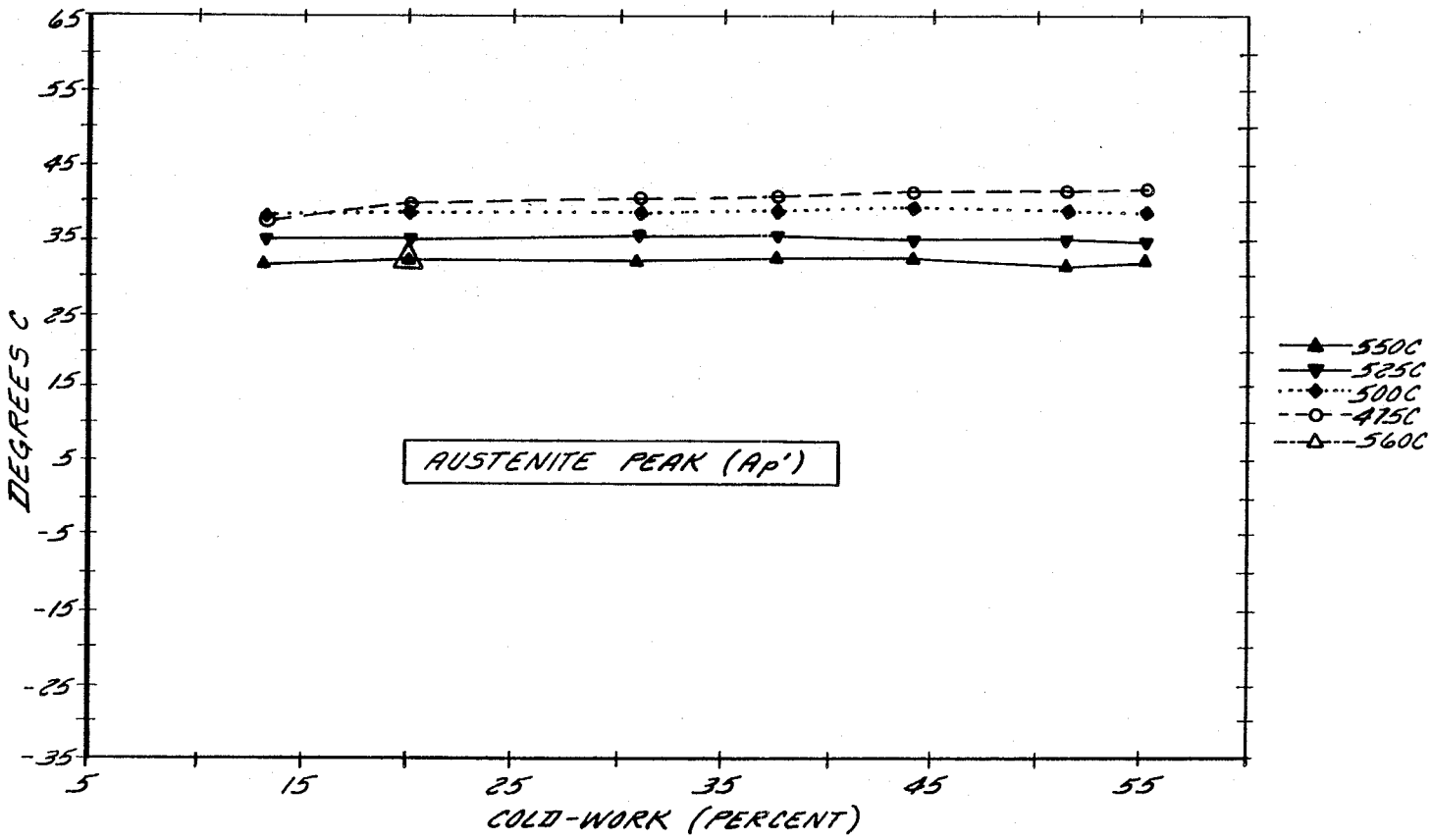
FIG. 5 is a family of curves showing the Austenite peak temperature of the ARA reaction at different amounts of internal stress and memory imparting temperatures.
Figure 6:
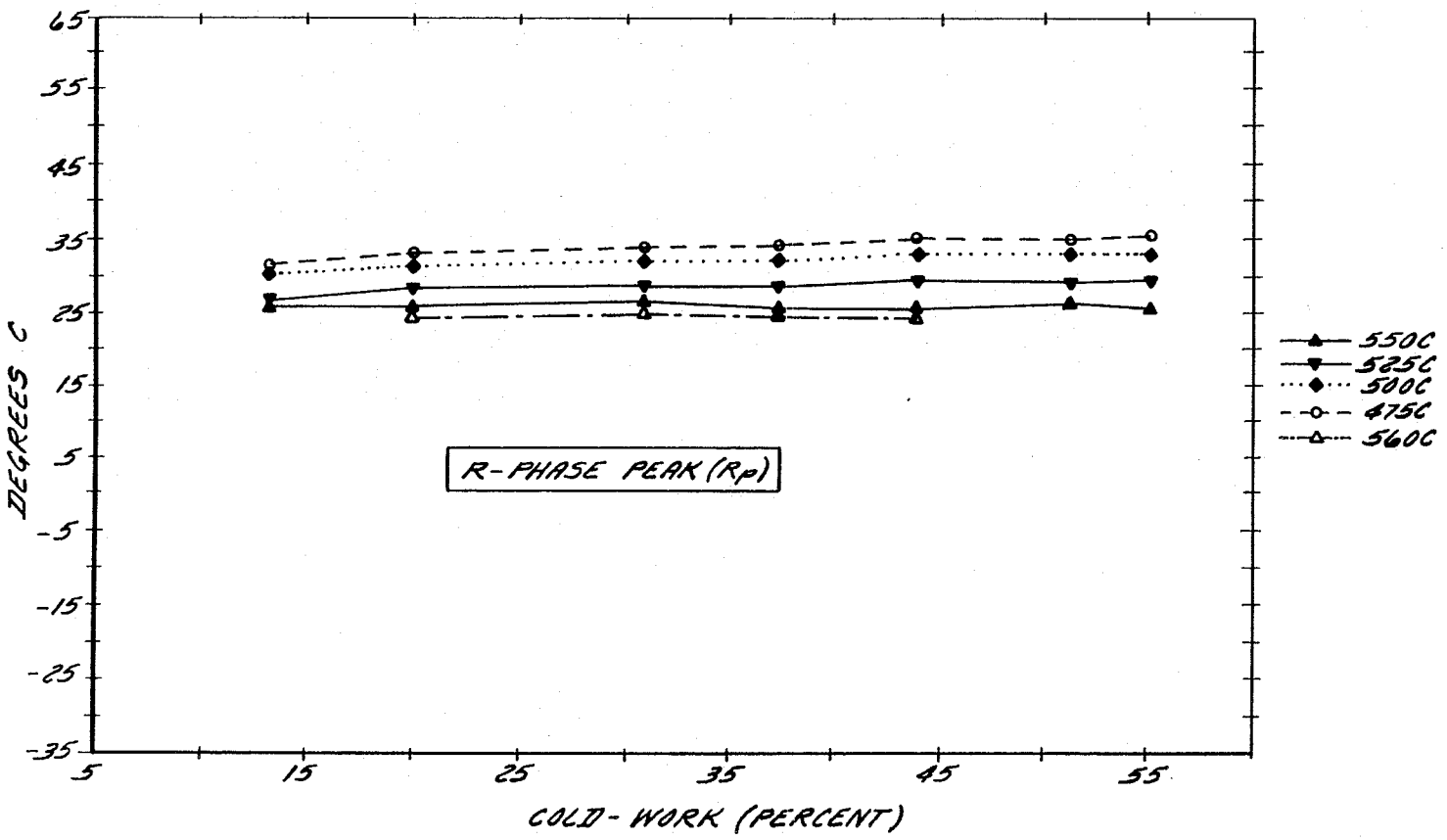
FIG. 6 is a family of curves showing the Rhombohedral peak temperature of the ARMA or ARA reactions at different amounts of internal stress and memory imparting temperatures.
Figure 7:
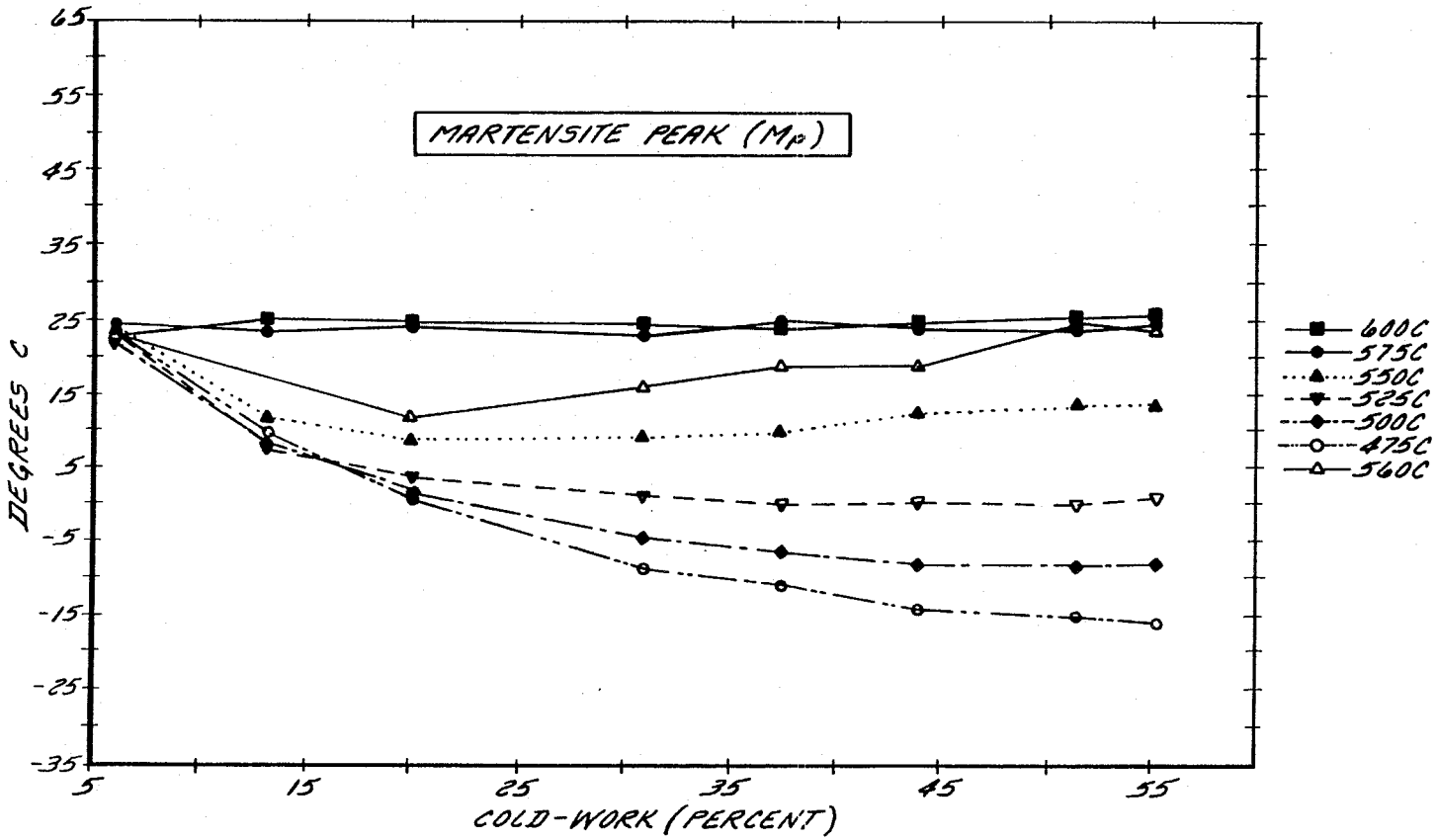
FIG. 7 is a family of curves showing the Martensite peak temperature of the ARMA or AMA reactions at different amounts of internal stress and memory imparting temperatures.

Referring to FIGS. 3 and 3*a*, the transformation reaction: Austenite to Rhombohedral to Martensite to Austenite phase- changes (ARMA) and the Austenite to Rhombohedral to Austensite phase changes (ARA) are depicted using Differential Scannng Calorimetry (DSC) plots. The plots show transition temperatures for high amounts of cold reduction, close to 55%, for this alloy with peak temperatures of 43.7°, 41.9°, 35.6° and −15.3° C. for the A, A', R and M phases respectively for 1 hour at 475° C. memory imparting temperature.

The process is then repeated for various amounts of cold reduction and memory imparting temperatures, which for this alloy are in the ranges of 5 to 60% and 400° to 600° C. respectively. FIGS. 4 through 7 respectively show the family of curves obtained for the peak transition temperatures of the Austensite, Ap (M to A); Austenite, A'p (R to A); Rhombohedral, Rp; and Martensite, Mp phases. The family of curves for this alloy are shown for 475° through 600° C. memory imparting temperatures for 1 hour.

Figure 8:
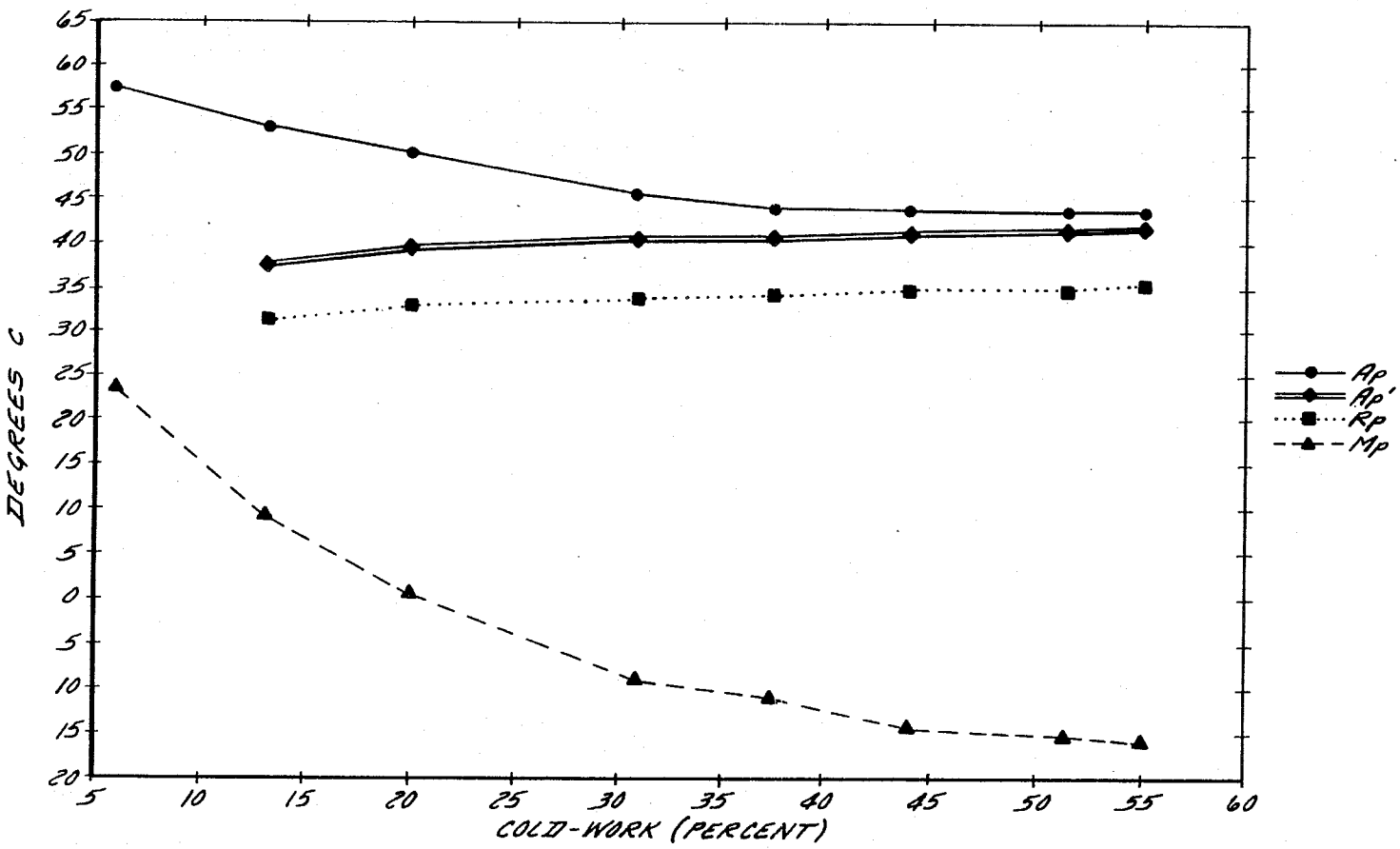
FIG. 8 is a family of curves showing the phase transformation peak tempertures at different amounts of internal stress and a memory imparting temperature of 475° C. for 1 hour.

FIG. 8 clearly shows the relationship between the degree of internal stress (cold work) and the transition temperature peaks of this alloy, at 475° C. memory imparting temperature for 1 hour.

Figure 9:
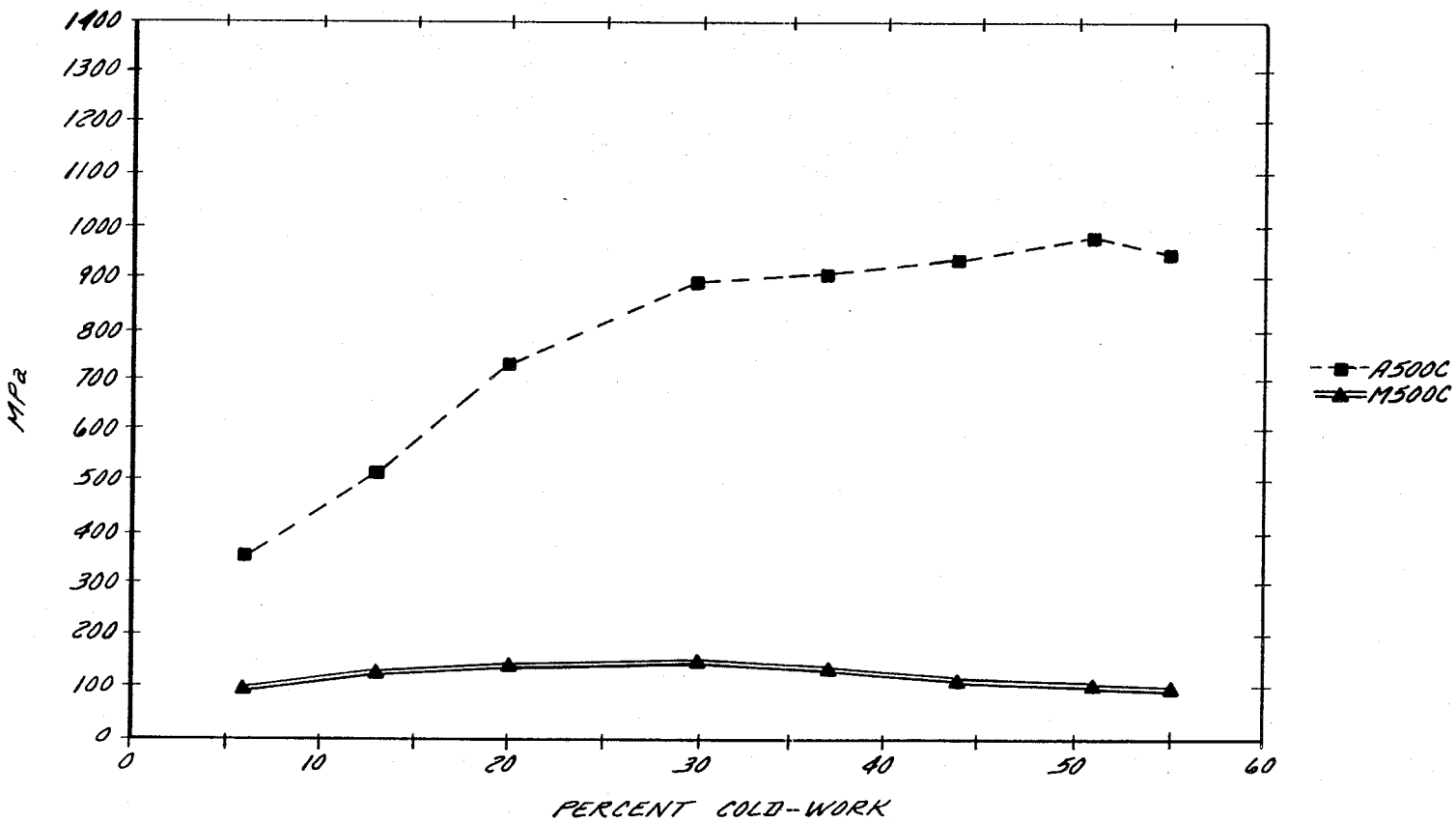
FIG. 9 is a family of curves showing the austenitic and martensitic yield strength at different amounts of internal stress at 500° C. memory imparting temperature for 1 hour.

FIG. 9 also clearly shows the relationship between the degree of internal stress (cold work) and the Yield Strength, both Austenite and Martensite phases, of this alloy, at 500° C. memory imparting temperature for 1 hour.

Figure 10:
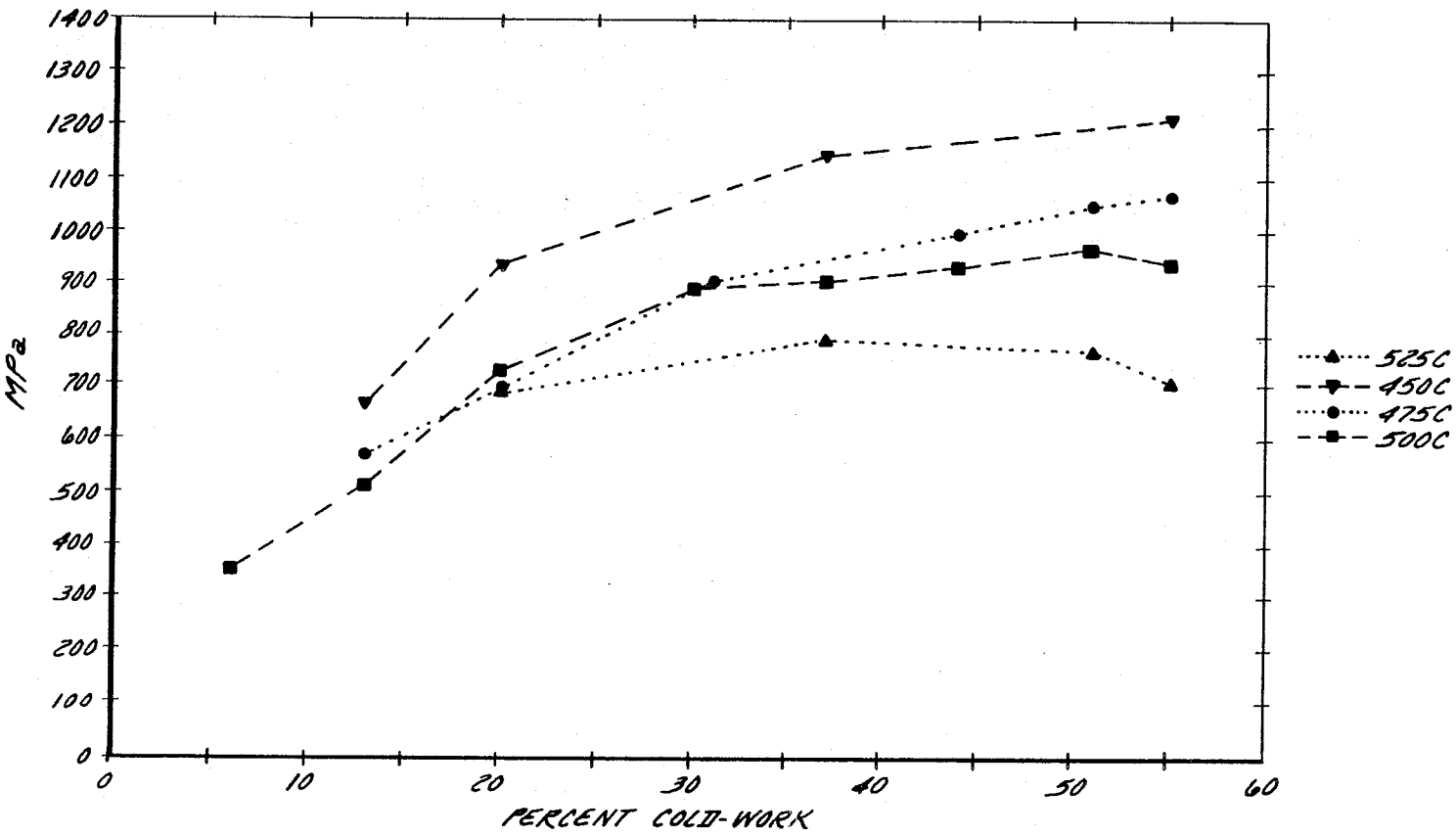
FIG. 10 is a family of curves showing the Austenite yield strength at different amounts of internal stress and memory imparting temperatures.

FIG. 10 shows the family of curves obtained for the Austenite phase yield strength for 450°, 475°, 500° and 525° C. memory imparting temperatures for 1 hour.

In the applications of SMA, there are instances where the crucial parameters relate to the physical properties such as the phase transition or transformation temperatures, the start and finish of a particular phase transformation and/or the hysteresis between the formation of one phase and another. The mechanical properties, however, are considered less crucial. In these applications the SMA members usually encounter low applied stresses and strains while requiring precise transition temperatures, narrow hysteresis loop and a small differential between the start and finish of the phase transformation. Such an application would be that of a thermal disconnect switch as in an overload protection circuit of electric motors.

A second type of SMA application which places more emphasis on the mechanical properties rather than physical would be an actuator with relatively high stresses and strains. Wider tolerances are acceptable on the actuation temperatures or hysteresis loop such as in the case of proportionally actuating an air damper over a 100° F. range or 90° of rotation.

A third type of application might involve both high mechanical output as well as close or tight temperature requirement as in the case of closing a fire trap door, fire sprinkler system valves, etc. actuating within several degrees centigrade.

Figure 11:
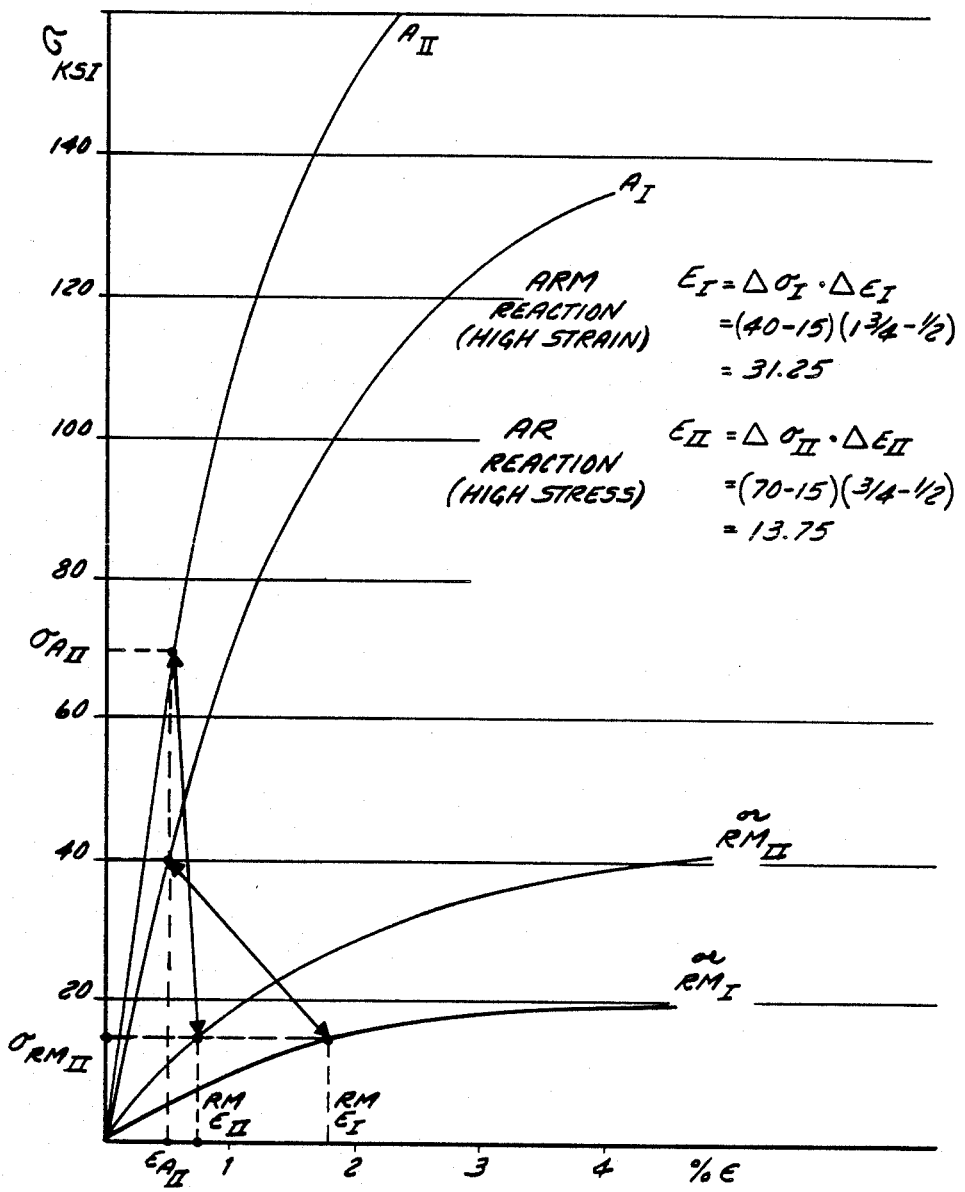
FIG. 11 is a stress/strain curve of both Austenite and Martensite at two levels of internal stress.

FIGS. 9 through 11 show the data that one obtains as a result of utilizing the process of adjusting the degree of internal stresses. From the physical parameter data, such as shown in FIGS. 1 through 8, and the mechanical parameter data, such as shown in FIGS. 9 and 10, one can select the appropriate amount of internal stress for a specific application. A sample calculation is shown in FIG. 11.

In SMA applications, the amount of work output delivered or produced by the elements, is proportional to the difference between the Austenitic and Martensitic strengths in A to M to A reactions and to the difference between the Austenitic and Rhombohedral strengths in A to R to A reactions. Referring to FIG. 9, the strength differential for this alloy at 30% cold work is shown to be approximately 750 Mpa (900-150); whereas the differential is only about 250 Mpa (350-100) at 6% cold work. The work output is best illustrated by FIG. 11 showing two stress/strain curves at two different degrees of internal stress levels (I and II). Referring to FIG. 11, two applications utilizing this process can be identified. In the first application of high strain/low stress, (I), for an ARMA reaction, the Martensite phase is strained to 1.75% and a stress of 15 KSI. In a second application of high stress/low strain, (II), for an ARA reaction, the Rhombohedral phase stress and strain are 15 KSI and 0.75% respectively. The corresponding Austenitic phase stress/strains are 40 KSI and 0.5% for the ARMA reaction (I), and 70 KSI and 0.5% for the ARA reaction. Hence, the energy product (work output) is $(40-15)\times(1.75-0.5)$ or 31.25 for the ARMA reaction and $(70-15)\times(0.75-0.5)$ or 13.75 for the ARA reaction.

In some specific applications it is desireable to have a progressively variable amount of internal stress and more particularly to widen hystersis loop of a SMA member.

Figure 12:
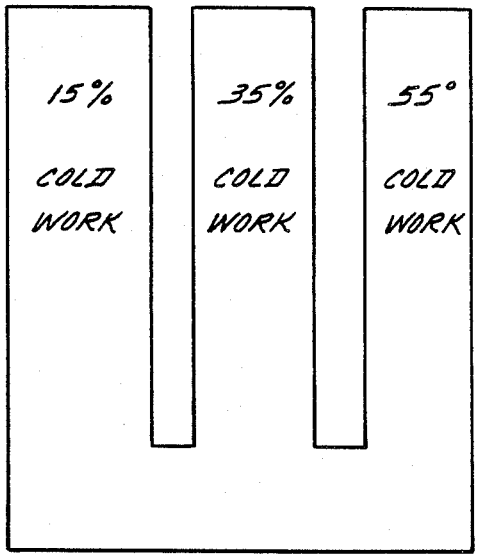
FIG. 12 is a sketch of a SMA member having a plurality of section with different stress levels.

In a step function application, it is desireable to stop the motion as a function of temperature in two or more steps. In this case, a plurality of integral sections of the SMA member have different internal stress levels, as shown in FIG. 12, leading to actuation of such sections in a predetermined sequence.

Thus it is apparent that there has been provided in accordance with the invention a method for controlling the transformation temperatures of SMA that fully satisfies the aims and advantages set forth above. While the invention has been described in conjunction with specific embodiments thereof, it is evident that there are many alternatives, modifications and variations that will be apparent to those skilled in the art. Accordingly, it is intended to embrace all such alternatives, modifications and variations as fall within the spirit and broad scope of the appended claims.

We claim:

1. A process for adjusting the physical and mechanical properties of a shape memory alloy member of a known chemical composition, said process comprising the steps of annealing said member to a reference internal stress level, introducing a controlled amount of internal stress into said member, forming the said member into a desired configuration, fixturing said member in the final desired configuration, the shape said member reverts to upon heating, and heat treating said member to obtain the desired physical and mechanical properties.

2. The process according to claim 1 including the step of determining the transformation temperatures of said member for the Austenite, Martensite and Rhombohedral phases.

3. The process according to claim 2 including the step of generating a family of phase transformation curves by repeating the steps of claim 2 at different internal stress levels and different memory imparting temperatures.

4. The process according to claim 1 including the step of determining the stress/strain behavior for the Austenite, Martensite and Rhombohedral phases.

5. The process according to claim 3 including the step of generating a family of stress/strain behavior curves by repeating the steps of claim 4 at different internal stress levels and different memory imparting temperatures.

6. The process according to claim 1 wherein said introducing step includes the additional step of introducing a progressively variable internal stress into said member.

7. The process according to claim 1 wherein said introducing step includes the introduction of a variety of different amounts of internal stress into selective portions of said member.

8. A process for adjusting the physical and mechanical properties of a shape memory alloy member of a known chemical composition and known internal stress level, said process comprising the steps of increasing the internal stress level of said member, and forming said member to a desired configuration, fixturing said member in the final desired configuration, the shape said member reverts to upon heating, and heat treating said member at a selected memory imparting temperature.

9. The process according to claim 8 including the step of determining the transformation temperatures of said member for the Austenite, Martensite and Rhombohedral phases.

10. The process according to claim 8 including the step of generating a family of phase transformation curves by repeating the steps of claim 9 at different internal stress levels and different memory imparting temperatures.

11. The process according to claim 8 including the step of determining the stress/strain behavior for the Austenite, Martensite and Rhombohedral phases.

12. The process according to claim 9 including the step of generating a family of stress/strain behavior curves by repeating the steps of claim 11 at different internal stress levels and different memory imparting temperatures.

13. The process according to claim 8 wherein said increasing step includes the additional step of introducing a progressively variable internal stress into alloy.

14. The process according to claim 8 wherein the increasing step includes the additional step of introducing a variety of different amounts of internal stress into selected portions of said member.

15. A process for adjusting the physical and mechanical properties of a shape memory alloy member of a known chemical composition and known internal stress level, said process comprising the steps of annealing said member at a predetermined temperature and time to establish a lower reference internal stress level, increasing the internal stress level of said member, forming said member to a desired configuration, fixturing said member in the desired configuration, the shape said member reverts to upon heating, and heat treating said member at a selected memory imparting temperature.

16. The process according to claim 15 including the step of determining the transformation temperatures of said member for the Austenite, Martensite and Rhombohedral phases.

17. The process according to claim 14 including the step of generating a family of phase transformation curves by repeating the steps of claim 16 at different internal stress levels and different memory imparting temperatures.

18. The process according to claim 15 including the step of determining the stress/strain behavior for the Austenite, Martensite and Rhombohedral phases.

19. The process according to claim 7 including the step of generating a family of stress/strain behavior curves by repeating the steps of claim 18 at different internal stress levels and different memory imparting temperatures.

20. The process according to claim 15 wherein said increasing step includes the additional step of introducing a progressively variable internal stress into said member.

21. The process according to claim 15 wherein said increasing step includes the introduction of a variety of different amounts of internal stress into selected portions of said member.

22. A process for adjusting the physical and mechanical properties of a shape memory alloy member of a known chemical composition, said process comprising the steps of annealing said member to a reference internal stress level, introducing a progessively variable internal stress into said member and heat treating said member to obtain the desired physical and mechanical properties.

23. A process for adjusting the physical and mechanical properties of a shape memory alloy member of a known chemical composition, said process comprising the steps of annealing said member to a reference internal stress level, introducing a variety of different amounts of internal stress into selected portions of said member, and heat treating said member to obtain the desired physical and mechanical properties.

24. A process for adjusting the physical and mechanical properties of a shape memory alloy member of a known chemical composition and known internal stress level, said process comprising the steps of increasing the internal stress level of said member by introducing a progessively variable internal stress into said alloy member, and heat treating said member at a selected memory imparting temperature.

25. A process for adjusting the physical and mechanical properties of a shape memory alloy member of a known chemical composition and known internal stress level, said process comprising the steps of increasing the internal stress level of said member by introducing a variety of different amounts of internal stress into selected portions of said member, and heat treating said member at a selected memory imparting temperature.

* * * * *